US005767433A

United States Patent [19]

Bill et al.

[11] Patent Number: 5,767,433

[45] Date of Patent: Jun. 16, 1998

[54] COMPONENT HOLDER FOR CARTRIDGE RELOADING

[75] Inventors: Eugene F. Bill, Oroville; Fred B. Blodgett, Chico; Arthur F. Peters, Oroville; Kurt Ranft, Oroville; Lester V. Rodrigues, Oroville; Ronald L. Smith, Oroville, all of Calif.; Donald A. Zuck, Lewiston, Id.

[73] Assignee: Blount, Inc., Montgomery, Ala.

[21] Appl. No.: 825,736

[22] Filed: Apr. 2, 1997

Related U.S. Application Data

[62] Division of Ser. No. 654,510, Jan. 16, 1996.

[51] Int. Cl.[6] ..... F42B 33/00; F42B 39/00; A47G 19/00

[52] U.S. Cl. ..... 86/45; 86/36; 206/3; 206/820; 220/23.4

[58] Field of Search ..... 42/89, 88; 89/35.01, 89/34; 102/281; 86/45, 48, 36; 206/3, 460, 528, 534.1, 531, 532, 813, 820, 504; 220/23.2, 23.4; 362/122, 123

[56] References Cited

U.S. PATENT DOCUMENTS

| | | | |
|---|---|---|---|
| Re. 29,705 | 7/1978 | Compere | 206/532 |
| 354,454 | 12/1886 | Wesson | 42/89 |
| 837,929 | 12/1906 | Hawley . | |
| 1,870,907 | 8/1932 | Groomes et al. | 220/23.4 |
| 2,298,089 | 10/1942 | Veenboer | 362/123 |
| 2,451,519 | 10/1948 | Studler | 89/35.01 |
| 2,480,972 | 9/1949 | Sanford et al. . | |
| 3,120,152 | 2/1964 | Horn et al. | 220/23.4 |
| 3,153,500 | 10/1964 | Pachmayr et al. | 206/3 |
| 3,184,054 | 5/1965 | Kuhlman | 220/23.4 |
| 3,283,425 | 11/1966 | Boyd . | |
| 3,349,710 | 10/1967 | Sposimo . | |
| 3,492,913 | 2/1970 | Barnard . | |
| 3,611,870 | 10/1971 | Udert et al. . | |
| 3,625,154 | 12/1971 | Gawlick et al. . | |
| 3,774,832 | 11/1973 | Maier . | |
| 3,813,987 | 6/1974 | Minneman . | |
| 3,921,805 | 11/1975 | Compere | 206/820 |
| 4,004,683 | 1/1977 | Pomeroy et al. . | |
| 4,056,062 | 11/1977 | Walser et al. . | |
| 4,063,672 | 12/1977 | Jochum . | |
| 4,098,169 | 7/1978 | Gawlick et al. . | |
| 4,106,619 | 8/1978 | Haytayan | 206/820 |
| 4,121,365 | 10/1978 | Hodil . | |
| 4,251,712 | 2/1981 | Parr | 206/460 |
| 4,402,153 | 9/1983 | Peter et al. . | |
| 4,406,079 | 9/1983 | Buechel et al. . | |
| 4,425,605 | 1/1984 | Cheng | 362/123 |
| 4,560,061 | 12/1985 | Haytayan . | |
| 4,565,114 | 1/1986 | Burdick et al. | 89/35.01 |
| 4,858,811 | 8/1989 | Brosius et al. . | |
| 4,862,622 | 9/1989 | Goyanes | 42/89 |
| 4,920,885 | 5/1990 | Bowman et al. . | |
| 4,966,298 | 10/1990 | Von Holdt | 206/504 |
| 5,036,746 | 8/1991 | Ehmig et al. . | |

(List continued on next page.)

*Primary Examiner*—Charles T. Jordan
*Assistant Examiner*—Theresa M. Wesson
*Attorney, Agent, or Firm*—Klarquist Sparkman Campbell Leigh & Whinston, LLP

[57] ABSTRACT

A holder for feeding components, such as primers or bullets, into a reloading machine is disclosed. The component holder is an elongate strip having notched longitudinal margins for indexing the strip as it progresses through the reloading machine. The strip includes a plurality of receptacles for holding components. Each receptacle has an inner surface that is a combination of a cylindrical portion, a prismatical portion, and a transition portion which cooperate to allow easy loading of the component into the strip and which firmly holds the component in place. The holder also includes an engagement portion so that successive holders may be ganged together to provide a continuous component holder for continuous reloading operations. A tape is applied to at least one side of the holder to cover the component held therein.

20 Claims, 2 Drawing Sheets

U.S. PATENT DOCUMENTS 5,150,964 9/1992 Tsui ..... 362/122
5,157,818 10/1992 Aurichio .
5,186,328 2/1993 Lenz et al. .
5,198,606 3/1993 Storstad et al. .
5,203,143 4/1993 Gutentag .
5,203,455 4/1993 Hewelt et al. .
5,208,420 5/1993 Hamilton et al. .
5,251,532 10/1993 Frommelt et al. .
5,379,888 1/1995 Rentos .
5,447,249 9/1995 Vickers ..... 220/23.4
5,492,065 2/1996 Jena et al. .
5,590,787 1/1997 Hodges .
5,664,877 9/1997 Wu ..... 362/123

10
12
22
26
24
14
20
18
46

42
32
40
36
30
28
34
37
38

44

10'
24'
26'

COMPONENT HOLDER FOR CARTRIDGE RELOADING

RELATED APPLICATIONS

This application is a divisional of U.S. patent application 08/654,510, filed on Jan. 16, 1996, pending under the title: A COMPONENT HOLDER FOR CARTRIDGE RELOADING

BACKGROUND OF THE INVENTION

1. Field of the Invention

This invention pertains to the field of ammunition reloading and particularly relates to ammunition reloading machines used by hobbyists.

2. Description of the Related Art

Many firearm enthusiasts reload their own ammunition to save money, control the quality of the reloading, and to have the ability to customize the ammunition. In very basic terms, the reloading operation consists of removing a spent primer from a cartridge case, resizing the cartridge case, and inserting powder and a new bullet and primer.

The primers are handled extensively and contain volatile materials. Traditionally, a box of primers, packed by the manufacturer, is dumped into a specially designed pan which is shaken to cause the primer cups to orient themselves with their proper ends up for reloading. The primers then are inserted by hand into tubes which serve as feed mechanisms for the reloading machines. One by one, the primers are extracted from the lower end of the tubes and transferred to a position under a deprimed shell. This movement intensive path from shipping container to shell is inconvenient. The primers can become a hazard if one primer detonates and causes sympathetic detonation of multiple primers. There is a need to streamline primer handling and to eliminate hazards.

There are other deficiencies inherent in the prior art primer handling system. One or more primers may be misaligned within the feed tube causing the primers to mis-feed in the reloading process. Also, it is common for avid sportsmen to experiment with primers of different kinds to achieve a desired performance. The feed tubes are cumbersome when the operator wants to switch to a different primer. The feed tube has to be emptied and refilled or switched with a different feed tube. Also, feed tubes often are opaque and mask the number of primers within.

Typical prior art shipping containers comprise a plastic rack with 100 holes that loosely hold primers. The primers are kept apart from one another to comply with Federal Transportation Safety codes. However, the geometry of these prior shipping containers dictates that the primers in the middle have eight closely adjacent primers which may cause problems.

Another drawback of shipping containers of the prior art is their lack of retaining means to prevent primers from spilling once the outer cardboard cover is removed. The primers rest loosely in the holes and the plastic rack is easily overturned causing the primers to fall out. Also, due to the multiple types of primers and their similar appearance, loose primers are easily confused. Sportsmen may have primers of several types in the reloading area, and distinguishing one from another is a time consuming and arduous task.

Bullets generally are also handled loosely in the reloading process. Though not capable of detonation, it is desirable to keep the bullets organized and provide the bullets automatically and sequentially to a reloading machine.

SUMMARY OF THE INVENTION

The present invention solves the aforementioned problems by providing a component holder into which primers can be factory loaded which serves to protect the primers during shipment and for quickly and safely feeding primers into a reloading machine. The primers are securely held by the holder until the reloading machine pushes the primer directly from the holder into a cartridge case or into the case by means of a transfer device.

Alternatively, the holder of the present invention can be used as a receptacle for bullets that likewise would be loaded at a manufacturing facility for safe and convenient shipment. The holder also provides a convenient and safe means of feeding the bullets in a sequential manner to a reloading machine.

A preferred embodiment of the present invention comprises an elongate strip having a plurality of receptacles, notched margins, an engagement member, and adhesive tape. The receptacles are openings through the elongate strip and include an inner surface having portions that grip a primer or bullet located in the receptacle. The notched margins provide a means of indexing the strip as it progresses through a reloading machine. The engagement member allows substantially identical strips to be connected together for continuous use of the reloading machine. Thus, after a first feeder strip is loaded into the reloading machine, it is not necessary to halt operations to reload subsequent strips. Rather, subsequent strips simply may be connected to the strip currently in the reloading machine for uninterrupted operations.

The adhesive tape is located along an entire length of the strip thereby covering an opening of the receptacles and providing a layer of protection for explosive devices located in the receptacles, such as primers. Preferably, the tape covers the anvil side of primers. The adhesive tape may include a non-adhesive tab to allow easier removal of the tape immediately prior to use in the reloading machine.

Various advantages and features of novelty which characterize the invention are particularized in the claims forming a part hereof. However, for a better understanding of the invention and its advantages, make reference to the drawings and to the accompanying description in which there is illustrated and described preferred embodiments of the invention.

DETAILED DESCRIPTION OF THE PREFERRED EMBODIMENTS

The following description relates primarily to a feeder strip or component holder used for storing, shipping, and providing reloading components to a reloading machine. The component holder may be used for transporting and providing primers, bullets or other suitably shaped components to a reloading machine. A difference between a component holder for primers and bullets is primarily the size of the receptacle.

Figures 1, 2, 3, 4:
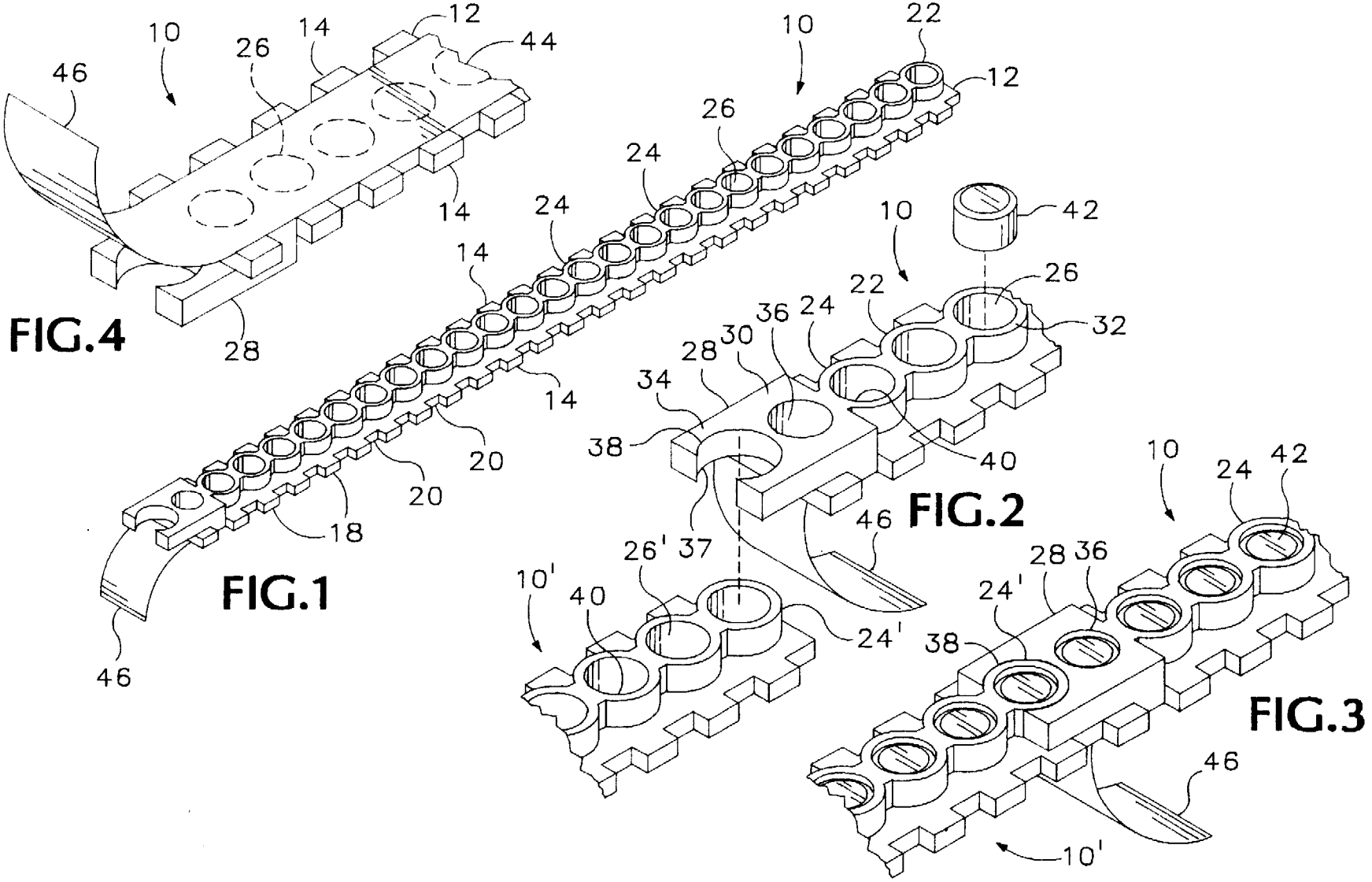
FIG. 1 is a perspective view showing a preferred embodiment of a component holder of the present invention.
FIG. 2 is an enlarged perspective view of adjacent ends of two component holders of the embodiment shown in FIG. 1 wherein an engagement portion at one end of one holder is in position to engage a second end of the other holder.
FIG. 3 shows the component holders of FIG. 2 coupled together in end-to-end alignment.
FIG. 4 is a perspective view showing a side of the component holder having an adhesive tape applied thereto.
Figure 8:
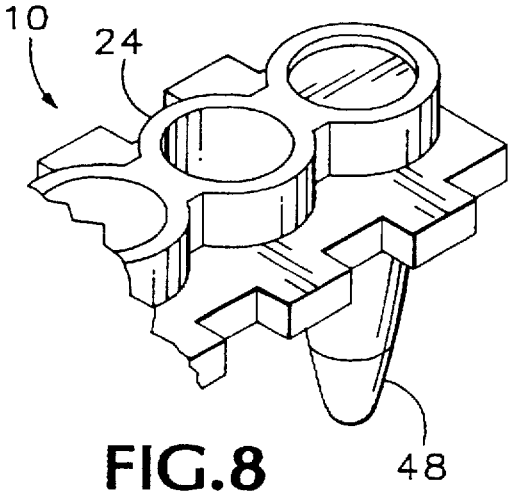
FIG. 8 is a perspective view of a portion of a component holder adapted to receive and hold a bullet.

FIG. 1 shows a preferred embodiment of an elongate component holder 10. Preferably, the holder is a molded polymeric part. A suitable material for the feeder strip is polypropelene, but other resilient polymerics also may be suitable.

The component holder, or strip, 10 includes various portions that perform different functions. A substantially planar portion 12 provides a basic frame for the component holder 10 and also includes notched, or castellated, margins 14 and 16. The margins 14, 16 include a plurality of teeth 18 and intermediate gaps 20 that cooperate to provide a means of indexing the component holder as it progresses through a reloading machine. The indexing components associated with the reloading machine are not a part of the invention described herein.

Another portion of the component holder 10 is a projecting or bas-relief portion 22 which includes a plurality of upstanding tubular members 24 that are shown arranged in tangential contact. Openings, or receptacles, 26 extend through the projecting portion 22 and the planar portion 12.

The projecting portion 22 also includes an engagement member 28 at one end of the component holder 10. Engagement member 28 includes a top surface 30 that is co-planar with tops 32 of the tubular members 24. Additionally, the engagement member 28 extends outward, longitudinally, beyond an end of the planar portion 12.

The engagement member 28 is shown in greater detail in FIGS. 2 and 3 where it can be seen that the engagement member includes a plate-like portion 34 having openings 36 and 38. The opening 36 forms a receptacle that includes an inner surface that is substantially similar to inner surfaces 40 of the other receptacles 26.

Conversely, opening 38 is semi-circular and larger, being sized to snugly receive and resiliently grip an outer surface of a tubular member 24. The opening 38 is bounded by a wall that is greater than 180° for attachment as will be described below, but has an open end region 37 to provide spring-like gripping. Accordingly, as shown in FIG. 2, the engagement member 28 of one component holder 10 may be located over a second component holder, e.g., 10', so that opening 38 is aligned over an endmost tubular member 24'. Thereafter, the engagement member 38 can be forcefully pushed onto the tubular member 24' so as to resiliently grip it as shown in FIG. 3. Thusly coupled, component holders 10 and 10' are longitudinally aligned to form a double-length component holder that may be continuously fed through a reloading machine.

In operation, a reloader will start a component holder through a reloading machine and as the holder gets close to an end, the reloader will take another component holder that is filled with primers and attach it to the component holder already in the reloading machine. Obviously, the operation can be continuously repeated indefinitely. As empty component holders come off the opposite end of the reloading machine they may be disengaged from the active component holder and discarded or saved for use with other primers.

In FIG. 2, a primer 42 is shown juxtaposed above a receptacle 26. In FIG. 3, the receptacles are shown with primers 42 located therein.

As noted, the bas-relief portion 22 is located along one side of the planar portion 12. Located along another side of the planar portion 12 is an adhesive tape 44 that extends the entire length of the component holder 10 and covers all of the receptacles 26. Preferably, when explosive components, such as primers, are loaded into the holder tape 44 covers their anvils. A suitable tape 44 is a 3M sealing tape that is 2 to 3 mil thick. Also, although not functionally shown, it is preferable that the tape 44 include a non-adhesive end portion 46 that is not adhered to the flat portion 12 and which provides a tab for easy removal of the tape.

When properly sized, the structure of the receptacles 26 provides a secure grip on round objects, such as primers 42 or bullets 48 located therein.

Figure 5:
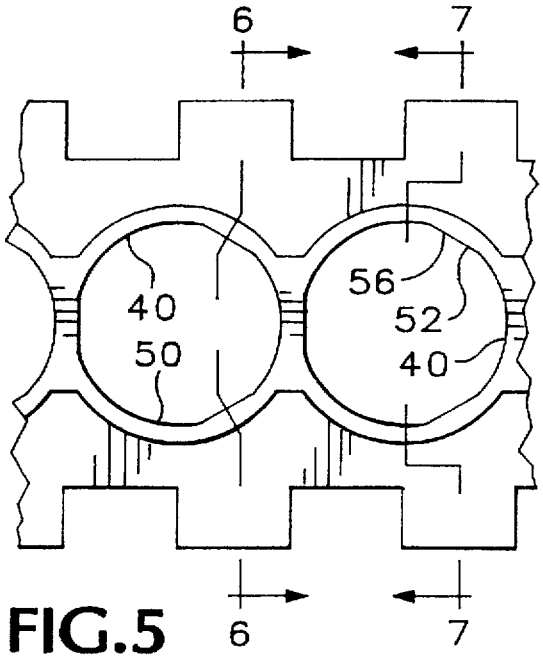
FIG. 5 is an enlarged top plan view of a portion of the component holder of FIG. 1.
Figure 6:
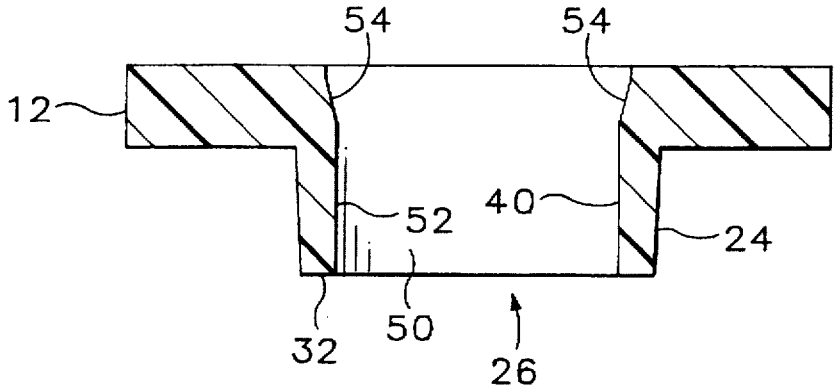
FIG. 6 is an enlarged cross section view taken along line 6—6 of FIG. 5.
Figure 7:
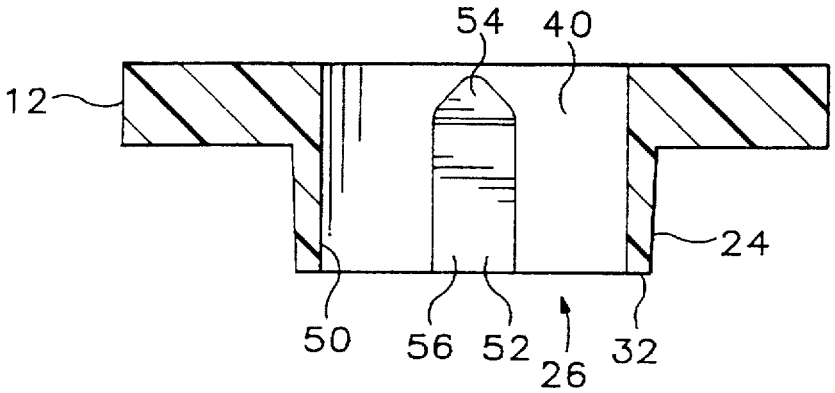
FIG. 7 is an enlarged cross section view taken along line 7—7 of FIG. 5.

FIGS. 5–7 show details of the receptacles 26 greatly enlarged and with exaggerated features to assist in communicating those features herein. Each receptacle 26 has an inner surface 40 which includes a cylindrical portion 50, a prismatical portion 52 and transition portions 54. The convergence of the cylindrical portion 50 and the prismatical portion 52 creates a substantially cylindrical inner surface 40 having a plurality of flats 56, which flats are associated with the prismatical portion 52. The flats extend from the tops 32 of the tubes 24 toward an opposite end of the receptacle 26, and terminate approximately three-quarters of the way down. Thereafter, the flats 56 (i.e., prismatical portions 52) are tapered into the cylindrical portion 50 thereby forming the transition portions 54.

The cylindrical portion 50 of the receptacles 26 is sized to receive round objects such as primers 42 or bullets 48. The prismatical portion 52 is sized so that the flats 56 press resiliently against the primer 42 or bullet 48 thus holding it firmly in place. The projecting portion 22 assists in this regard because the thinner walls around the receptacle along the tubular members 24 is more yieldable than the thicker walls along the planar portion 12. The transition portions 54 are provided as a transition from the cylindrical portion 50 to the prismatical portion 52, thus acting as ramps to assist in loading primers or bullets into the receptacles 26.

Preferably, the prismatical portion 52 has three sides (i.e., an equilateral triangular cross-section) thus creating three flats 56 which would press against the primer 42 or bullet 48 and hold it in the center of the receptacle. However, other prismatical shapes having different polyhedron configurations could also be used.

Alternatives to the above embodiments include holders 10 having no bas-relief portion, i.e., the planar portion 12 would be thicker to create the proper thickness for the receptacles 26. Also, other types and designs of engagement members such as mortise and tenon, tab and socket, clip and pintle, may also serve.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

We claim:

1. A component holder for cartridge reloading, comprising an elongate strip having a plurality of holes for receiving a respective number of reloading components, the elongate strip having a first end and a second end wherein the first end includes an engagement portion and the second end includes an engaging portion that can couple to an engagement portion of a second component holder to form a continuous, elongate strip of a plurality of holders for continuous, uninterrupted use in a cartridge reloading device.

2. The component holder of claim 1 wherein each hole includes an inner surface having a cylindrical portion and a prismatical portion.

3. The component holder of claim 1 wherein each hole includes an inner surface having a cylindrical portion, transition portions, and a prismatical portion such that the inner surface is predominately cylindrical and the prismatical portion interrupts the cylindrical portion thereby forming flats that extend from a region adjacent one end of the hole toward the opposite end of the hole but terminate short thereof, and the transition portions extend from the flats to the cylindrical portion progressing toward said opposite end of the hole.

4. The component holder of claim 1 wherein the elongate strip is substantially linear.

5. The component holder of claim 1 wherein an entire longitudinal margin portion of the strip has indexing elements defined therealong.

6. The component holder of claim 1 wherein the strip includes opposed longitudinal margin portions that have indexing elements defined therealong.

7. The component holder of claim 1 wherein the strip comprises an elongate planar portion having a plurality of tubular members in substantial tangential contact projecting outwardly from the planar portion.

8. The component holder of claim 1 wherein the strip comprises an elongate planar portion and opposing outwardly projecting walls that are continuous between the holes.

9. A component holder for cartridge reloading, comprising an elongate strip having a plurality of receptacles extending therethrough, each receptacle having an inner surface that includes a curvilinear portion and at least one substantially flat portion whereby the substantially flat portion assists in gripping and retaining objects inserted into the receptacle and an engagement member coupled to a first end of the strip that can couple to a second end of a second holder for forming an elongate gang of component holders.

10. The holder of claim 9 further comprising a plurality of annular tubes, the engagement member coupled to a first end of the strip and engageable to an annular tube at a second end of a second holder for forming a gang of component holders.

11. The holder of claim 9 wherein the engagement member comprises a planar piece having a semi-circular hole therein.

12. A holder for storing and providing components to a reloading device, comprising:

(a) an elongate strip having a first side that is substantially planar and a second side having a planar portion and an outwardly projecting portion, the strip further having a plurality of openings passing through the planar side and the projecting portions, the strip further having at least one margin with positioning elements defined therealong; and (b) an engagement portion having a receptacle for receiving a section of a projecting portion of a second, substantially similar holder.

13. The holder of claim 12 wherein the engagement portion comprises a plate extending from the projecting portion to a region beyond the end of the planar side.

14. The holder of claim 12 wherein the projecting portion comprises a plurality of tangentially contacting tubes.

15. The holder of claim 12 further comprising a layer of protective material adhesively coupled to the first side of the strip and arranged to cover the openings.

16. The holder of claim 12 further comprising a plurality of primers frictionally engaged within the openings and a layer of protective material adhesively coupled to the first side of the strip and arranged to cover the openings and the primers within the openings.

17. The holder of claim 12 wherein each opening has an inner surface having a prismatical portion, a cylindrical portion and at least one transition portion.

18. A holder for holding cartridge reloading components, comprising a plurality of receptacles linearly arranged along a strip, having an engagement member at one end thereof for coupling the holder to a second holder in an end-to-end fashion.

19. A holder for holding reloading components, comprising a plurality of receptacles linearly arranged along a strip having an engagement member at one end thereof for coupling the holder to a second holder in an end-to-end fashion, wherein the receptacles have an inner surface that is substantially tubular with at least one substantially flat portion that extends across the receptacle wherein cylindrical objects can be received within the receptacle and frictionally engage at least the one substantially flat portion.

20. A holder for holding reloading components, comprising a plurality of receptacles linearly arranged along a strip having an engagement member at one end thereof for coupling the holder to a second holder in an end-to-end fashion, wherein the engagement member comprises a plate at one end of the strip having a semi-circular opening therein and a receptacle adjacent the opposite end of the strip comprises a tubular projection that can be frictionally received within such a semi-circular opening on a second holder.

* * * * *